US006651266B1

(12) United States Patent
Liu et al.

(10) Patent No.: US 6,651,266 B1
(45) Date of Patent: Nov. 25, 2003

(54) FLUSHING METHOD OF TOILET, TOILET USED FOR CARRYING OUT SAID METHOD AND COMPONENTS THEREOF

(75) Inventors: Cheng Liu, Beijing (CN); Bing Hua Chen, Beijing (CN); Sili He, Beijing (CN)

(73) Assignees: Beijing Zhonglian Huan-Jietong, Beijing (CN); Water-Saving Technology Co., Ltd.

( * ) Notice: Subject to any disclaimer, the term of this patent is extended or adjusted under 35 U.S.C. 154(b) by 0 days.

(21) Appl. No.: 10/088,624

(22) PCT Filed: Jun. 8, 2000

(86) PCT No.: PCT/CN00/00146

§ 371 (c)(1),
(2), (4) Date: Mar. 19, 2002

(87) PCT Pub. No.: WO01/55516

PCT Pub. Date: Aug. 2, 2001

(30) Foreign Application Priority Data

Jan. 27, 2000 (CN) ..... 00100671 A

(51) Int. Cl.[7] ..... E03D 1/00

(52) U.S. Cl. ..... 4/425; 4/300.3; 4/309; 4/323; 4/324; 4/328; 4/370

(58) Field of Search ..... 4/300.3, 309, 323, 4/326, 328, 370, 425, 426

(56) References Cited

U.S. PATENT DOCUMENTS

| | | | | | |
|---|---|---|---|---|---|
| 359,913 | A | * | 3/1887 | White | 4/328 |
| 1,111,747 | A | * | 9/1914 | Haas | 4/336 |
| 1,928,717 | A | * | 10/1933 | Campus | 4/422 |
| 3,224,013 | A | * | 12/1965 | Tubbs | 4/425 |
| 4,984,306 | A | * | 1/1991 | Sumerix | 4/226.1 |
| 5,067,181 | A | | 11/1991 | Hafner et al. | |
| 5,109,550 | A | * | 5/1992 | Makita et al. | 4/300 |
| 5,502,845 | A | * | 4/1996 | Hayashi et al. | 4/300 |

FOREIGN PATENT DOCUMENTS

| | | |
|---|---|---|
| DE | 2700781 | 7/1978 |

* cited by examiner

*Primary Examiner*—Gregory L. Huson
*Assistant Examiner*—Azy Kokabi
(74) *Attorney, Agent, or Firm*—Fish & Richardson P.C.

(57) ABSTRACT

A toilet flushing method causes high-pressure flush water, provided by a flow pipe, to spray along the baffle in the bottom of the trap of a toilet bowl and causes the flush water used for washing the toilet bowl to spray into the toilet bowl. The high-pressure flush water discharges the egesta with water in order to supply sealing water to the trap. A toilet, which uses components for improving the prior art toilet, carries out the flushing method.

4 Claims, 10 Drawing Sheets

FLUSHING METHOD OF TOILET, TOILET USED FOR CARRYING OUT SAID METHOD AND COMPONENTS THEREOF

TECHNICAL FIELD

The present invention relates to the flushing method of toilet and the apparatus therefor.

BACKGROUND TECHNOLOGY

The sealing between the outlet of conventional toilet bowl and the sewer generally adopts a Z-shaped trap. The function of the trap is the sealing of water and prevention of escape of unpleasant odour from the sewer. The higher the trap is situated, the more water is stored and the tighter is the sealing. The egesta in the trap and the flushing water are to be discharged by means of the principle of siphon. The more water stored in the trap, the more difficult is the flushing and the more water is consumed. Moreover, the existing toilet is generally provided with a watertank, so the water source with a constant pressure provided by the converter pump or the water reservoir in high building can not be directly used. And as the components in the watertank of the toilet are subject to worn-out and damage, the phenomena of spilling and leaking would frequently occur, and also the toilet bowl is difficult to be cleanly flushed and the drain conduit is apt to be blocked up and form dirt.

SUMMARY OF INVENTION

The object of the present invention is to provide a flushing method of toilet which has auxiliary discharging and cleaning units in the trap. Another object of the present invention is to provide the toilet for carrying out the above-mentioned method.

A further object of the present invention is to provide the components for improving the existing toilet.

The flushing method of toilet of the present invention comprises the steps of spraying the high-pressure flush water that is provided by a flow pipe along the baffle of the toilet bowl in the bottom of the trap of the toilet bowl, spraying the flush water for washing the toilet bowl in said toilet bowl, and after said high-pressure efflux has discharged the egesta with the sealing water and the flushing water, supplying the sealing water to the trap.

The toilet of the present invention comprises a toilet bowl and a trap, a nozzle for producing a high-pressure efflux being provided at the bottom of the trap of the toilet near the juncture of the rear side-wall of the toilet bowl and the baffle, the orientation of this high pressure efflux being generally parallel to the extending direction of the baffle, the nozzle being in communication with a flushing control valve through an efflux communing pipe, the flushing control valve being in communication with a flow pipe, a water supply tank being in communication with the efflux communicating pipe and at least one nozzle for flushing the bowl being provided in the bowl, the nozzle being in communication with the flushing control valve through a flushing communicating pipe.

The toilet components of the present invention comprise an efflux nozzle for producing the high pressure efflux provided at the bottom of the trap of the toilet near the juncture of the rear side-wall of the toilet bowl and the baffle, the orientation of the high pressure efflux being generally parallel to the extending direction of the baffle; at least one flushing nozzle provided in the bowl for the use of flushing the bowl; a water intake pipe passing through the mounting hole on the bowl, said water intake pipe being in communication with the flushing control valve, said efflux nozzle and the flushing nozzle, said control valve being in communication with a flow pipe and a water supply tank communicating with the water intake pipe.

The further solution of the present invention is as follows:

The water supply tank has an air escape check valve;

The water supply tank is connected with a toilet cleaning agent charging unit. The charging unit has a toilet cleaning agent valve controlled by the pressure of the water supply tank to make the sealing water added to the trap containing toilet cleaning agent.

The efflux nozzle and the flushing nozzle are both connected to a base in which are provided an upper water supply passage and a lower water supply passage. A downward facing fan-shaped slot is provided at the front end of the base perpendicular to the direction of the axis of the base. The fan-shaped slot is in communication with the upper water supply passage and forms a fan-shaped nozzle for flushing the rear part of the bowl. An inclined jet orifice is provided behind the fan-shaped slot. The jet orifice is in communication with the lower water supply passage and forms a dashing nozzle for dashing away the egesta. The flushing nozzles are symmetrically disposed on the base. The flushing nozzles are in communication with the upper water supply passage and form a nozzle for flushing the two lateral sides and the front portion of the bowl. A water volume adjusting device is provided in the upper water supply passage.

The toilet components also include a decorative shield for the purpose of covering.

According to the present invention, a nozzle is provided in the trap to produce a high pressure efflux supplied by the flow pipe to quickly crush the egesta and discharge them into the sewer so to raise the flushing efficiency and reduce the water consumption. The volume of the flushing water is only one fifth of the normal consumption. The crushed egesta will not be susceptible to adhering to the drain conduit so blocking up will rarely occur. As the water tank is dispensed with and the number of components is reduced, the phenomena of spilling and leaking caused by damage of the water tank components will be put an end to and much of the space in the toilet room can be saved. This saved space can be used for installing an armchair or a cabinet etc. Since the consumption of the supplying water is scanty, so is the toilet cleaning agent added to the supplying water for eliminating dirts and odour.

DETAILED DESCRIPTION OF THE PREFERRED EMBODIMENTS

Figure 1:
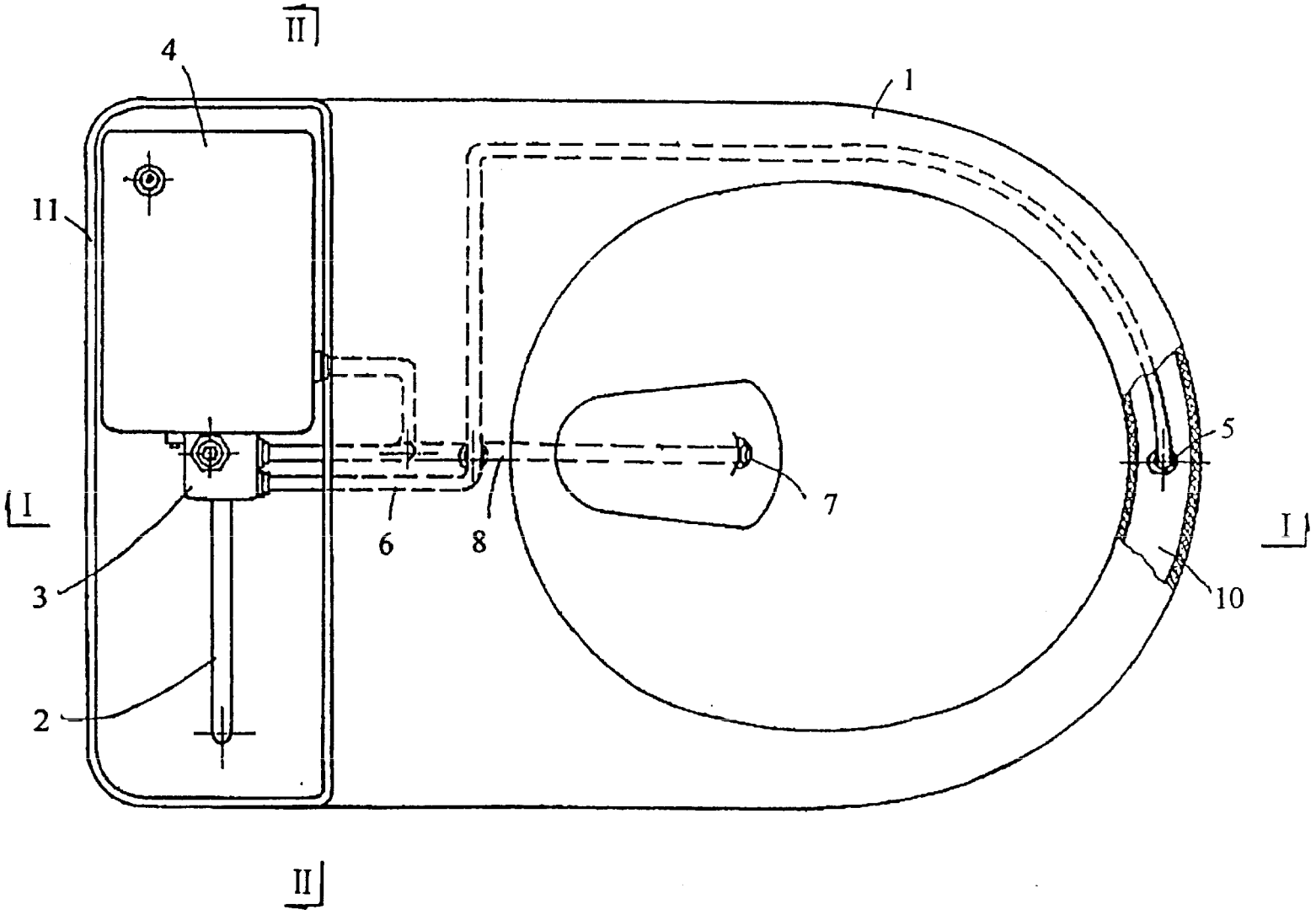
FIG. 1 is a partial cutaway plan view of the toilet of the present invention.
Figure 2:
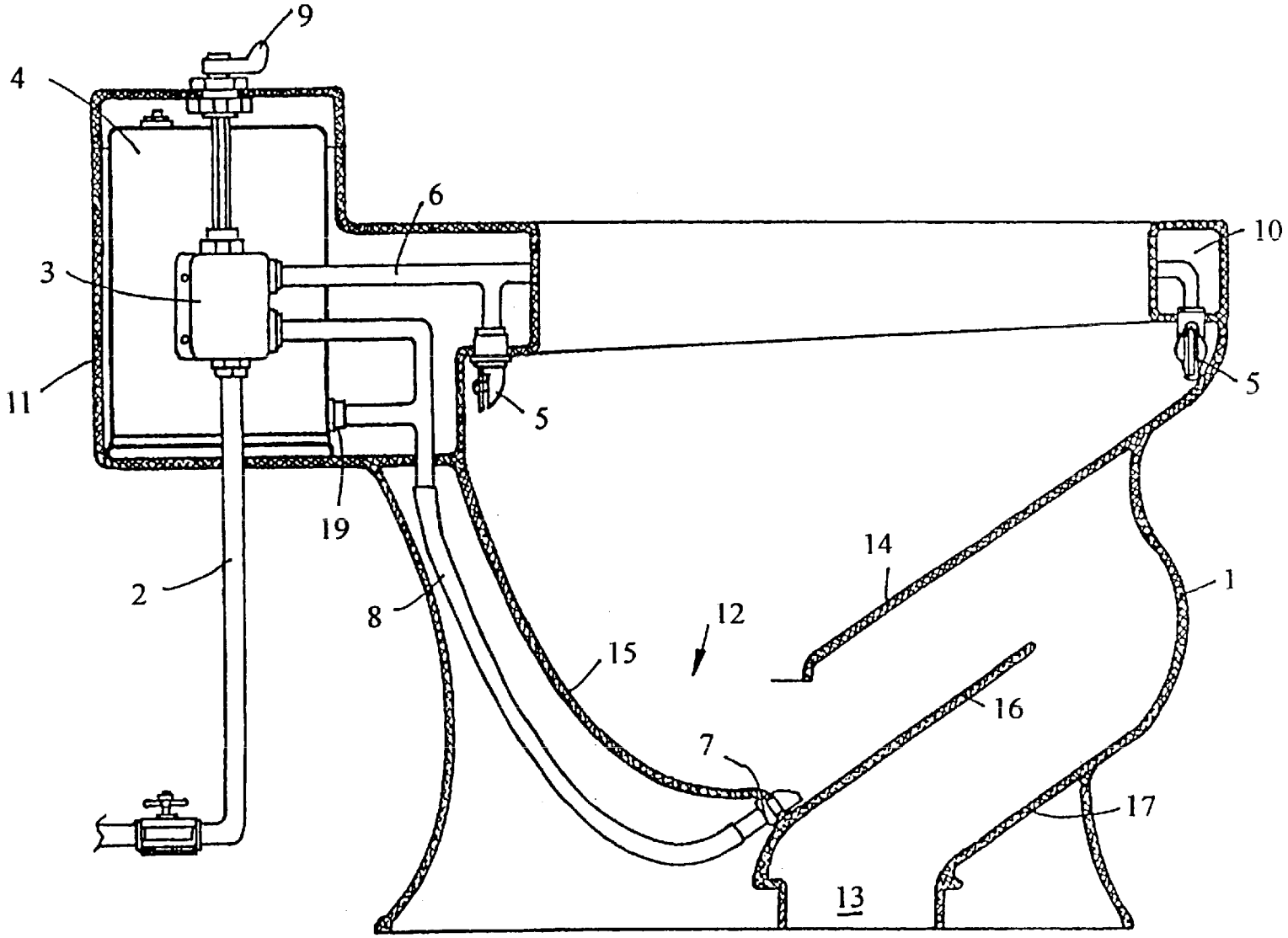
FIG. 2 is a sectional view taken along line I—I in FIG. 1.

Referring to FIGS. 1 and 2, the toilet of the present invention comprises a toilet bowl 1 and a trap 12. Trap 12 is constituted of rear side-wall 15 of bowl 1, baffle 16 and the front side-wall 14 of the bowl. The baffle 16 and the bottom board 17 of the toilet constitute the drain passage 13. The drain passage 13 is connected with a drain conduit (not shown). A nozzle 7 producing a high pressure efflux is provided at the bottom of the trap 12 of the toilet near the juncture of the rear side-wall 15 of the toilet bowl 1 and the baffle 16, and the orientation of the high pressure efflux is generally parallel to the extending direction of the baffle 16. The nozzle 7 being in communication with a flushing control valve 3 through an efflux communicating pipe 8, the flushing control valve 3 being in communication with a flow pipe 2. In the tank body 11 is provided a water supply tank 4 the volume of which is equivalent to the volume of water being stored in the trap 12 and generally less than 1/10 of the volume of a conventional toilet water tank. The water supply tank 4 has an inlet 19, which is in communication with the efflux communicating pipe 8. In bowl 1 is provided a flushing nozzle 5 for flushing bowl 1, the mounting angle of which is adjustable to be adjusted according to different water pressure. Said nozzle 5 can be any nozzle which can adjust the direction of the flushing water. In the present embodiment, there are two nozzles 5, one provided at the front end and the other at the rear end, flushing nozzle 5 being in communication with the flushing control valve 3 through a flushing communicating pipe 6. The flushing communicating pipe 6 is mounted within the circulating conduit 10, which is formed around the upper rim of bowl 1. The control valve 3 and the water supply tank 4 are installed in the tank body 11, which is in communication with the circulating conduit 10. The control valve 3 might be a valve with one inlet and two outlets, that is, it has one inlet communicating with flow pipe 2 and two outlets which communicate respectively with the flushing communicating pipe 6 and the efflux communicating pipe 8. The control valve 3 might also be a valve with one inlet and one outlet, that is, it has one inlet communicating with flow pipe 2 and one outlet communicating with both the flushing communicating pipe 6 and the efflux communicating pipe 8. A rotating handle 9 is used for controlling the opening and closing of the flushing control valve 3.

Figure 4:
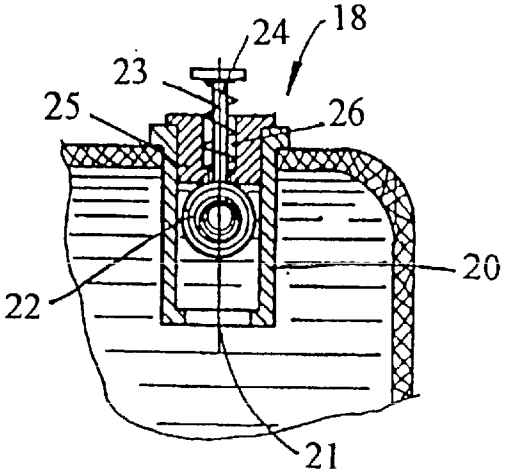
FIGS. 4 and 5 are schematic views showing the operation states of the air escape chick valve employed in the water supply tank according to the present invention respectively.
Figure 5:
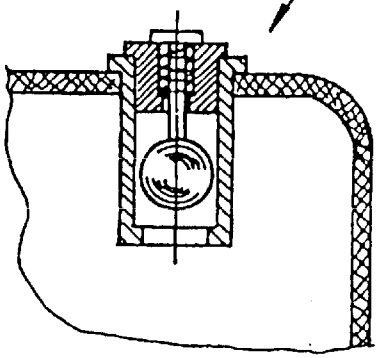
Figure 3:
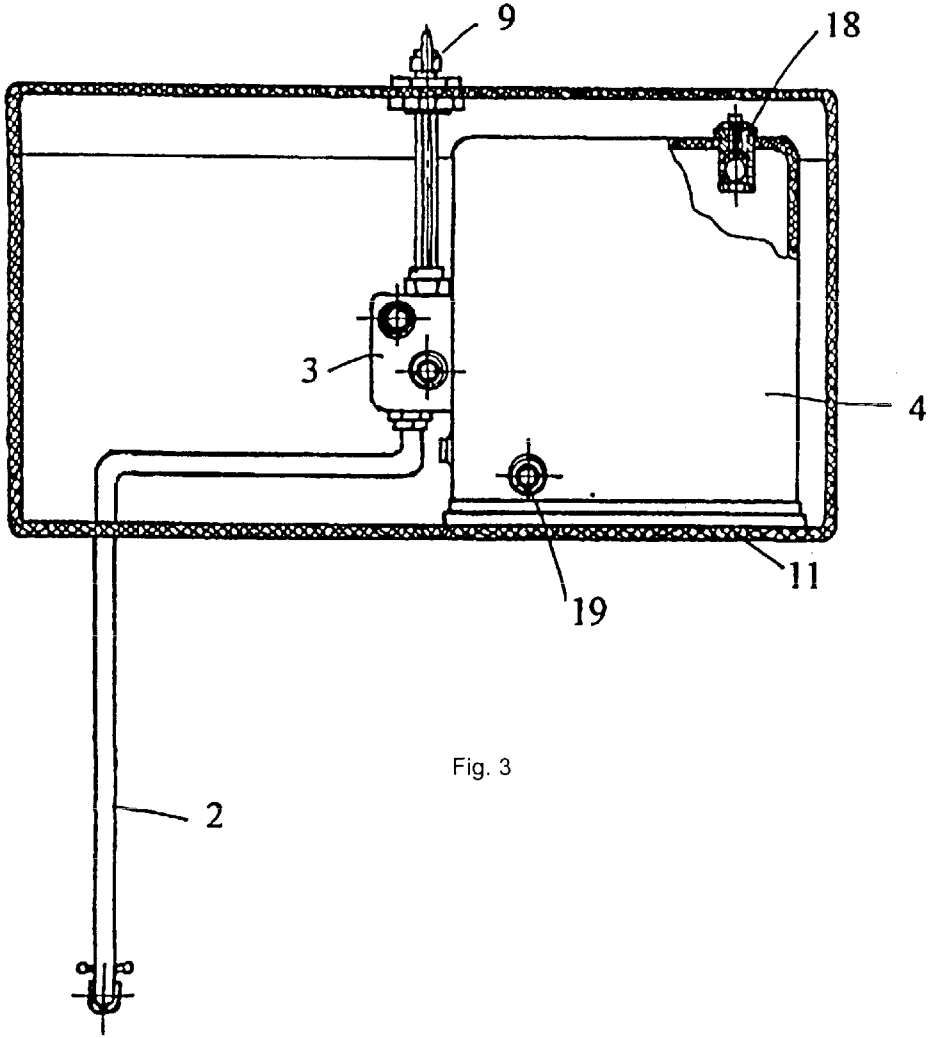
FIG. 3 is a sectional view taken along line II—II in FIG. 1.

Referring to FIGS. 3–5, the water supply tank 4 has an air escape check valve 18 mounted on the top of the water supply tank 4. This valve 18 has a sleeve 20. A fluid inlet 21 is provided at the bottom of the sleeve 20 which is connected with the housing of the water supply tank 4. A valve seat 25 which has a through hole 26 is mounted in the sleeve 20. A valve core 22 which is connected with a guide-bar 23 passing through the through hole 26 is also provided in the sleeve 20. The guide-bar is fitted over by a spring 24. One end for the spring 24 is connected to the valve seat 25 and the other end is connected to the guide bar 23. The valve core 22 can close the through hole 26. FIG. 4 shows the state that the valve core 22 has closed the through hole 26 when the water supply tank 4 is full of water and FIG. 5 shows the state when the through hole 26 is opened.

Figure 6:
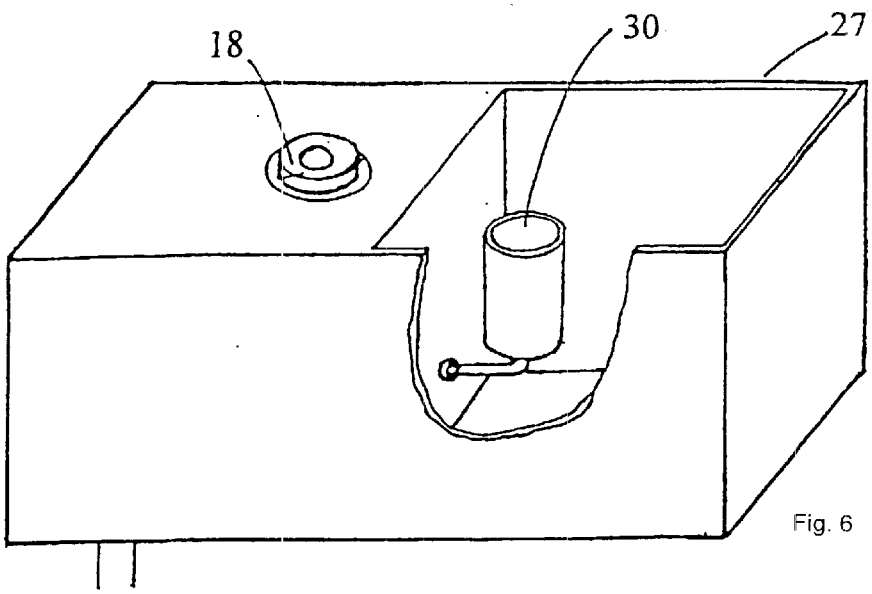
FIG. 6 is a perspective view of the water supply tank with a toilet cleaning agent charging unit according to the present invention.
Figure 7:
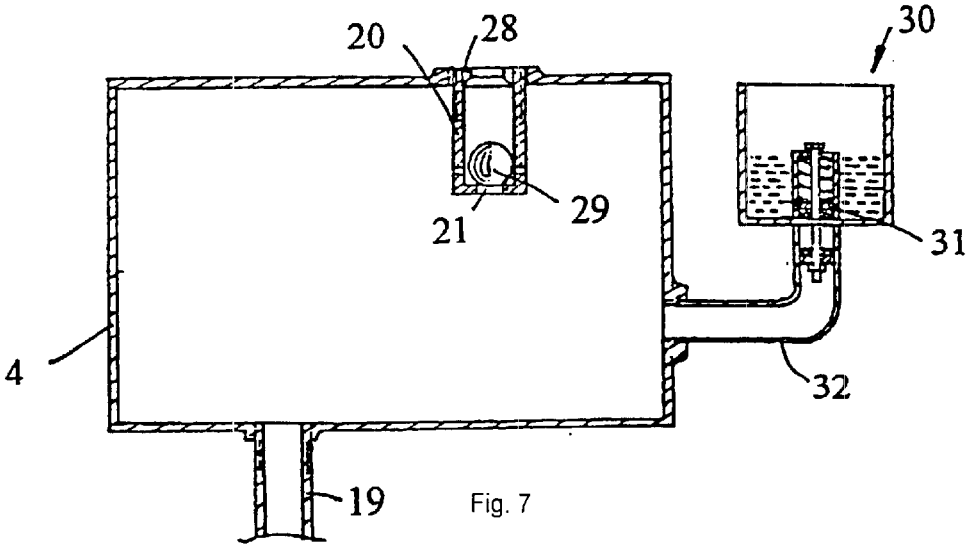
FIG. 7 is a sectional view of the water supply tank and the toilet cleaning agent charging unit.
Figure 8:
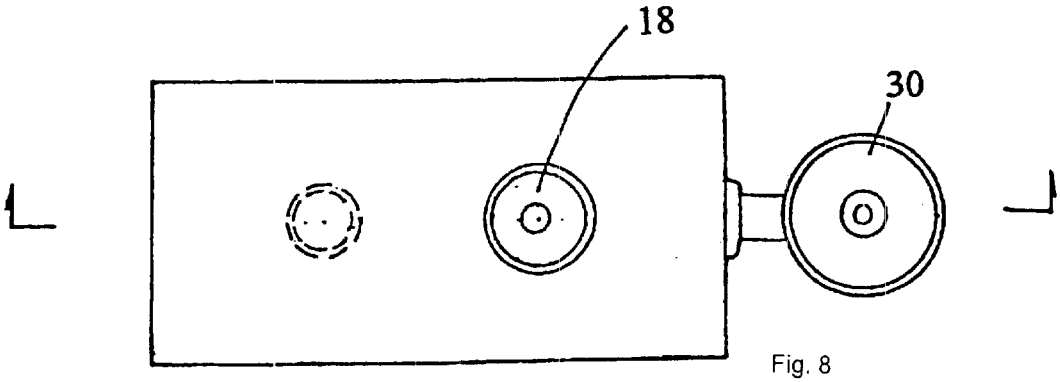
FIG. 8 is a plan view of FIG. 6.

Referring to FIGS. 6–8, the water supply tank 4 of the present invention has a toilet cleaning agent charging unit 30. The charging unit 30 has a toilet cleaning agent valve 31 controlled by the pressure in the water supply tank 4 to make the sealing water supplied to the trap containing toilet cleaning agent. The charging unit 30 is installed in the storage tank 27.

Referring to FIG. 7, in the embodiment shown in FIG. 7, the air escape check valve 18 has a sleeve 20 at the bottom of which is provided a fluid inlet 21. The sleeve 20 is connected to the housing of the water supply tank. A valve seat 28 is mounted in the sleeve 20. A through hole 26 is provided in the valve seat 28. A floating ball 29 for closing the through hole 26 is provided in the sleeve 20.

Figure 9:
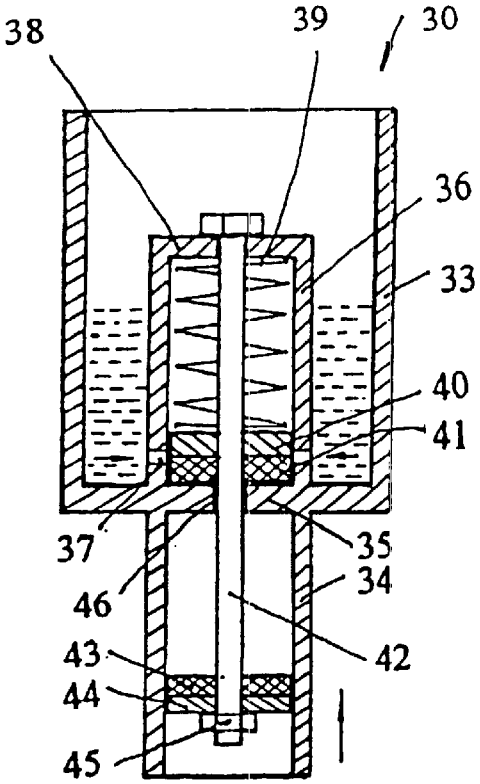
FIG. 9 is an enlarged sectional view of the toilet cleaning agent shown in FIG. 7.

Referring to FIG. 9, the toilet cleaning agent valve 31 mounted in the shell body 33 of the charging unit 30 has a guide pipe 32 and a cylinder body 36. One end of the guide pipe 32 is in communication with the water supply tank 4 and the other end by which the guide pipe 32 is connected to the shell body 33 has a vertically upward pipe segment 34.

A partition board 35 having a through hole 46 is provided between the pipe segment 34 and cylinder body 36. A stop block 38 with a hole is provided on the top of the cylinder body 36 and an inlet 37 for the toilet cleaning agent is provided at the bottom of the cylinder body 36. A bolt 42 is inserted into the pipe segment 34 through the hole on the stop block 38 and the through hole 46 on the partition board 35. A piston piece 40, a sealing gasket 41 and a spring 39 is mounted on the bolt 42 disposed in the cylinder body 36. A piston piece 44, a sealing gasket 43 and a nut 45 is mounted on the bolt 42 disposed in the pipe segment 34.

Figure 10:
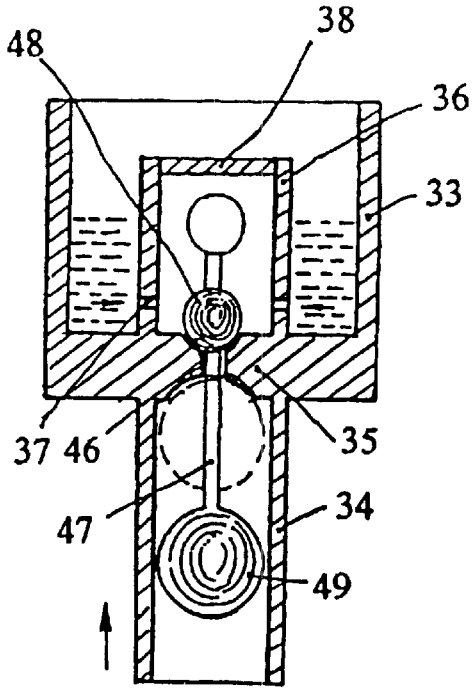
FIG. 10 is an enlarged sectional view of an alternative embodiment of the charging unit shown in FIG. 9.

FIG. 10 shows an alternative embodiment of the charging unit of FIG. 9. In this embodiment, the same parts as shown in FIG. 9 are indicated by the same reference numerals. The difference between this embodiment and the embodiment shown in FIG. 9 is that the bolt 42 is replaced by a screw rod 47. The upper and lower ends of screw rod 47 are respectively connected with spherical pistons 48 and 49, and recesses to engage with the spherical pistons 48 and 49 are provided on the partition board 35.

Figure 11:
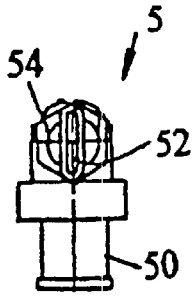
FIG. 11 is a side view of a nozzle employed by the present invention.
Figure 12:
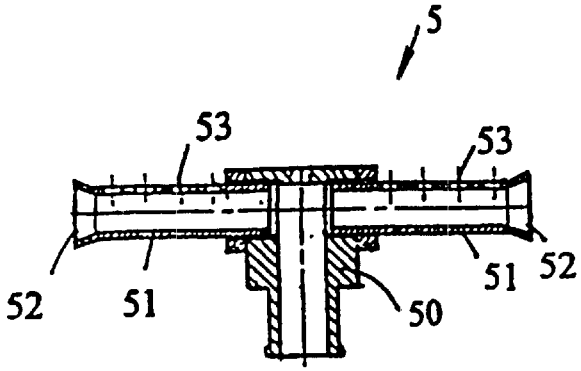
FIG. 12 is a front sectional view of the nozzle shown in FIG. 11.

FIGS. 11 and 12 show a flushing nozzle 5 employed by the present invention. This flushing nozzle 5 has a three-way base 50 which has one inlet and two outlets. Each of the outlets is fitted with a flushing pipe 51. Flushing orifices are opened lengthwise on the pipes 51, and the ends of the pipes 51 are crushed to form narrow slit nozzles 52. Female thread is provided in the two outlets of the base 50 and male thread is provided on the pipes 51. Nuts 54 are provided on pipes 51, and the pipe 51 is fixed in the base 50 by the nuts 54.

Figure 13:
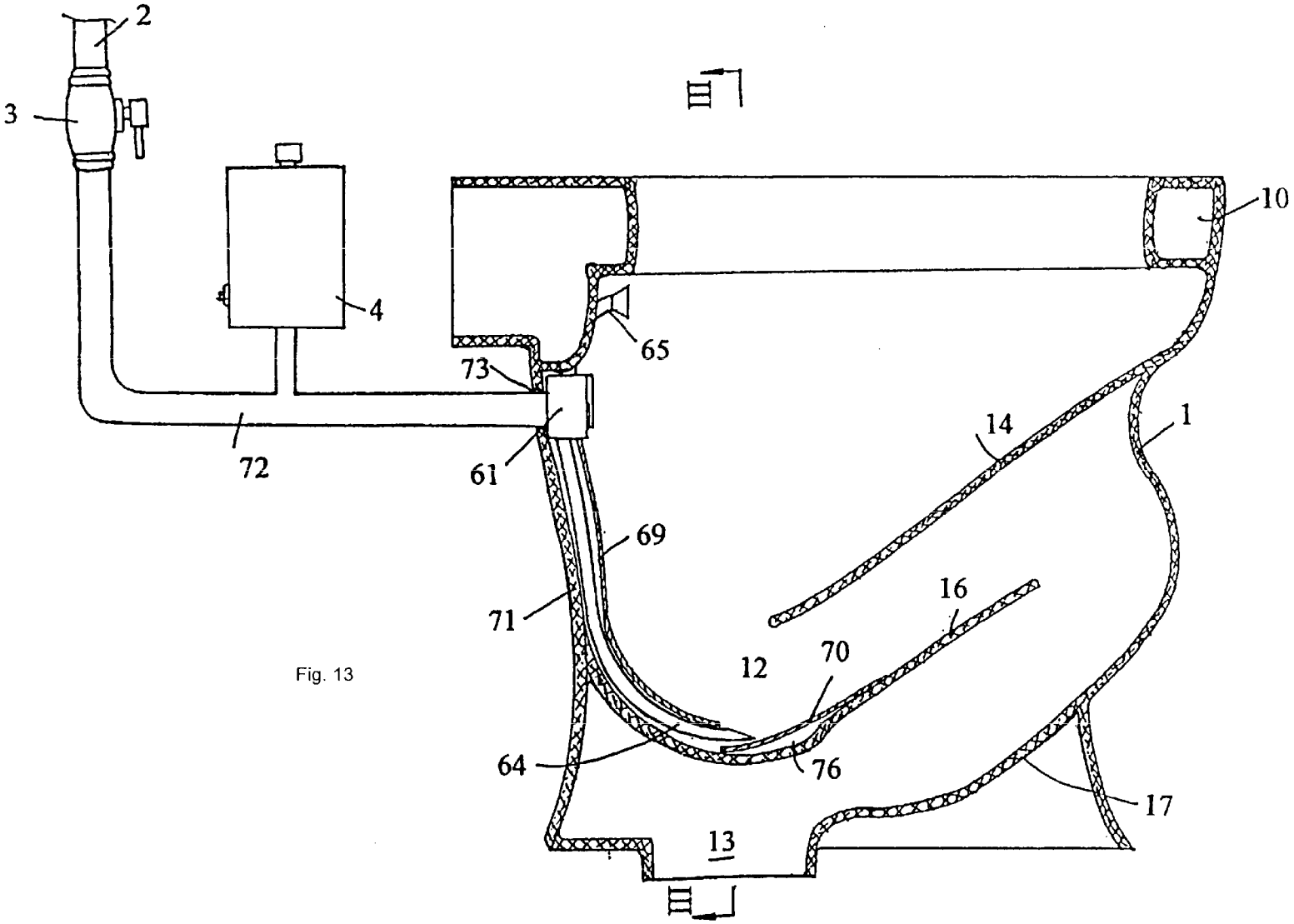
FIG. 13 is a sectional view of a toilet with the toilet components of the present invention.
Figure 14:
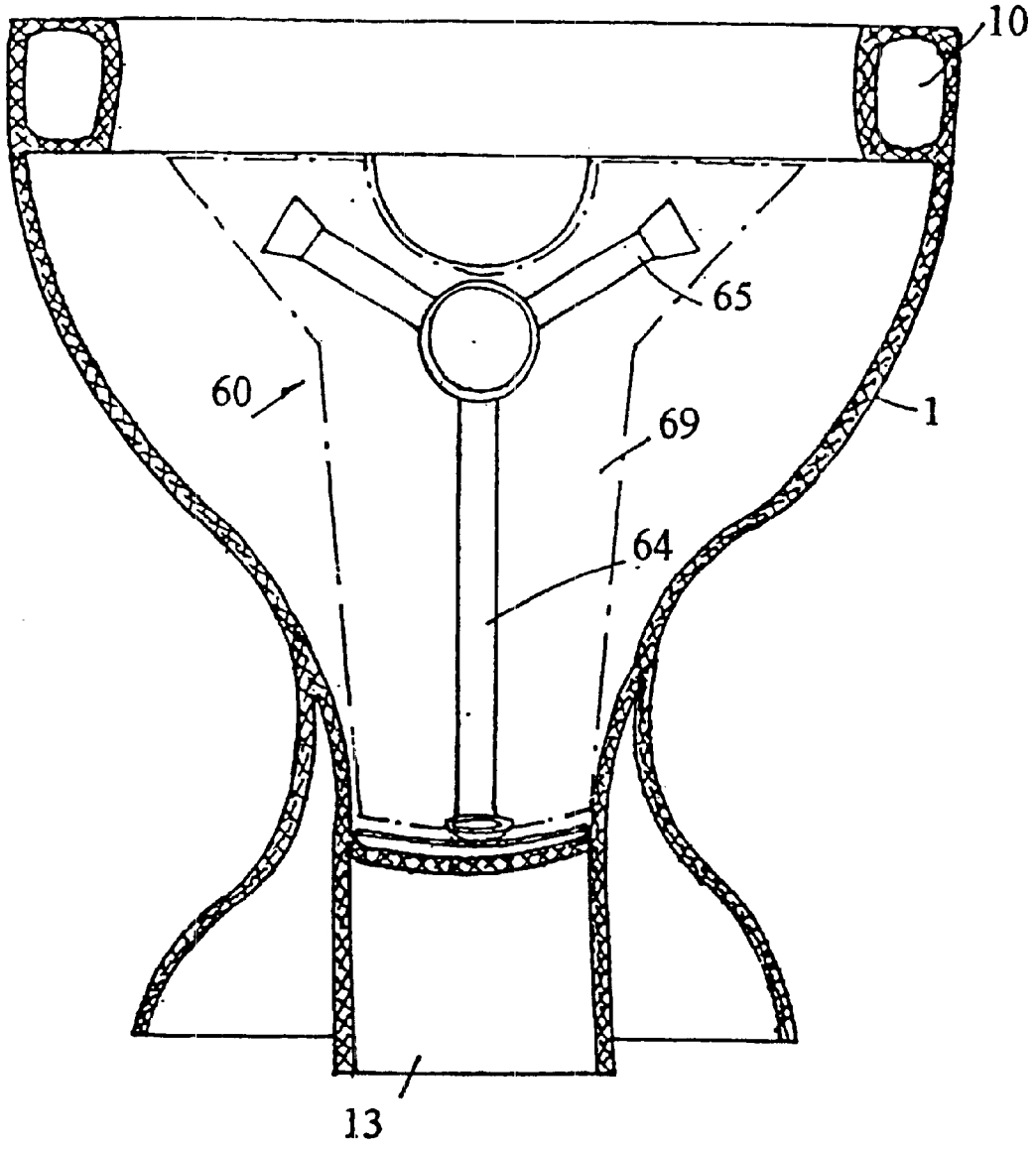
FIG. 14 is a sectional view taken along the line III—III in FIG. 13.

FIGS. 13 and 14 are schematic views showing the assemblage of the toilet components of the present invention to improve the prior art toilet. The toilet bowl 1 shown in the drawing is a bowl of the conventional type. The same reference numerals in the drawings indicate the same parts or similar locations.

In the embodiment shown in FIGS. 13 and 14, the toilet components 60 of the present invention comprise: an efflux nozzle 64 producing the high pressure efflux provided at the bottom of the trap of the toilet near the juncture of the rear sidewall of the toilet bowl 1 and the baffle 16, the orientation of the high pressure efflux being generally parallel to the extending direction of the baffle 16; two flushing nozzles 65 for flushing the bowl provided in the bowl 1; a base 61 for connecting the efflux nozzle 64 and with the flushing nozzle 65; a water intake pipe 72 passing through the mounting hole 73 on the bowl, one end of the water intake pipe 72 communicating with the flushing control valve 3 and the other end communicating with the base 61, the control valve 3 communicating with a flow pipe 2; and a water supply tank 4 communicating with the water intake pipe 72, which the water supply tank 4 can be the water supply tank described above and employ corresponding accessories.

The toilet components also include a decorative shield 69 for the purpose of covering. It is employed to cover over the whole bowl 1 except the portion where the nozzle orifice should be exposed.

In the conventional toilet bowl, some of the baffles 16 have depression 76 at the lower end. The function of such depression is to retain more water. However, this depression is disadvantageous to the flow of the efflux, hampering the discharge of the egesta. For this reason, a water deflecting plate 70 is provided by the present invention, which can be put over the deppression 76 by means of adhesives or the like.

Figure 17:
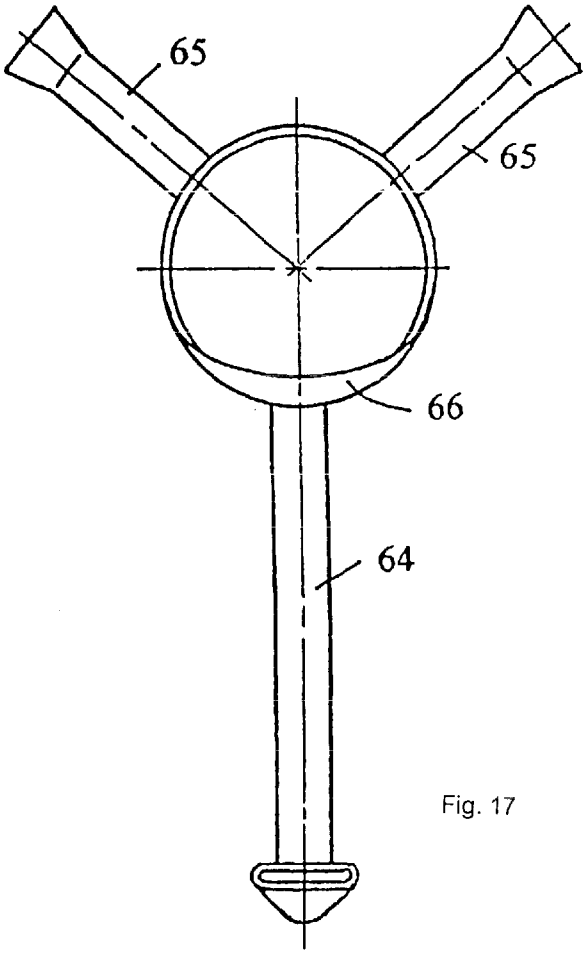
FIG. 17 is a left view of the toilet shown in FIG. 15.
Figure 15:
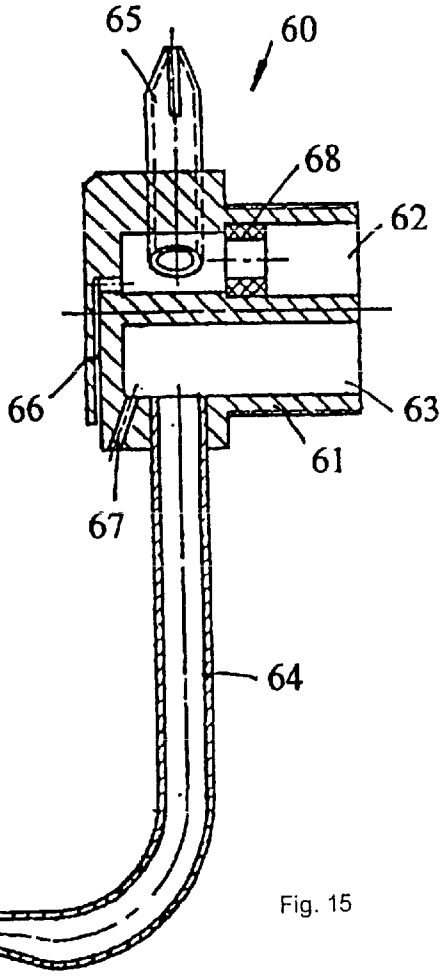
FIG. 15 is a sectional view of the toilet components of the present invention.
Figure 16:
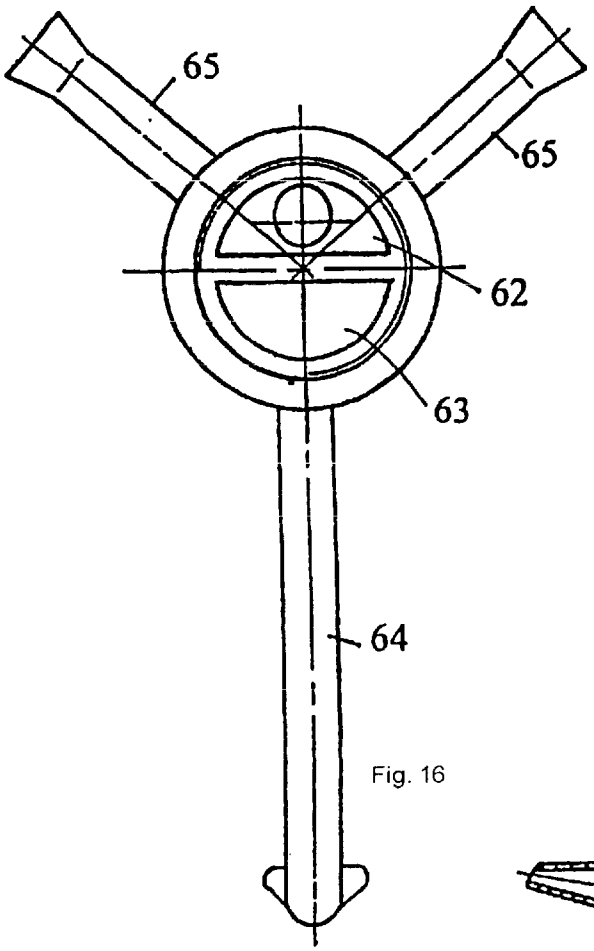
FIG. 16 is a right view of the toilet shown in FIG. 15.

Referring to FIGS. 15–17, an upper water supply passage 62 and a lower water supply passage 63 are provided in the base 61. A downward facing fan-shaped slot 66 is provided at the front end of the base perpendicular to the direction of the axis of the base. The fan-shaped slot 66 is in communication with the upper water supply passage 62, and form a fan-shaped nozzle 66 for flushing the rear part of the bowl. An inclined jet orifice 67 is provided behind the fan-shaped slot 66. The jet orifice 67 is in communication with the lower water supply passage 63, and form a dashing nozzle 67 for dashing the egesta out. Two symmetrically arranged flushing nozzles 65 are also provided on the base 61. The flushing nozzles 65 are in communication with the upper water supply passage 62, and form nozzles for flushing two lateral sides and the front part of the bowl. A water volume adjusting device 68 is provided in the upper water supply passage 62.

Figure 18:
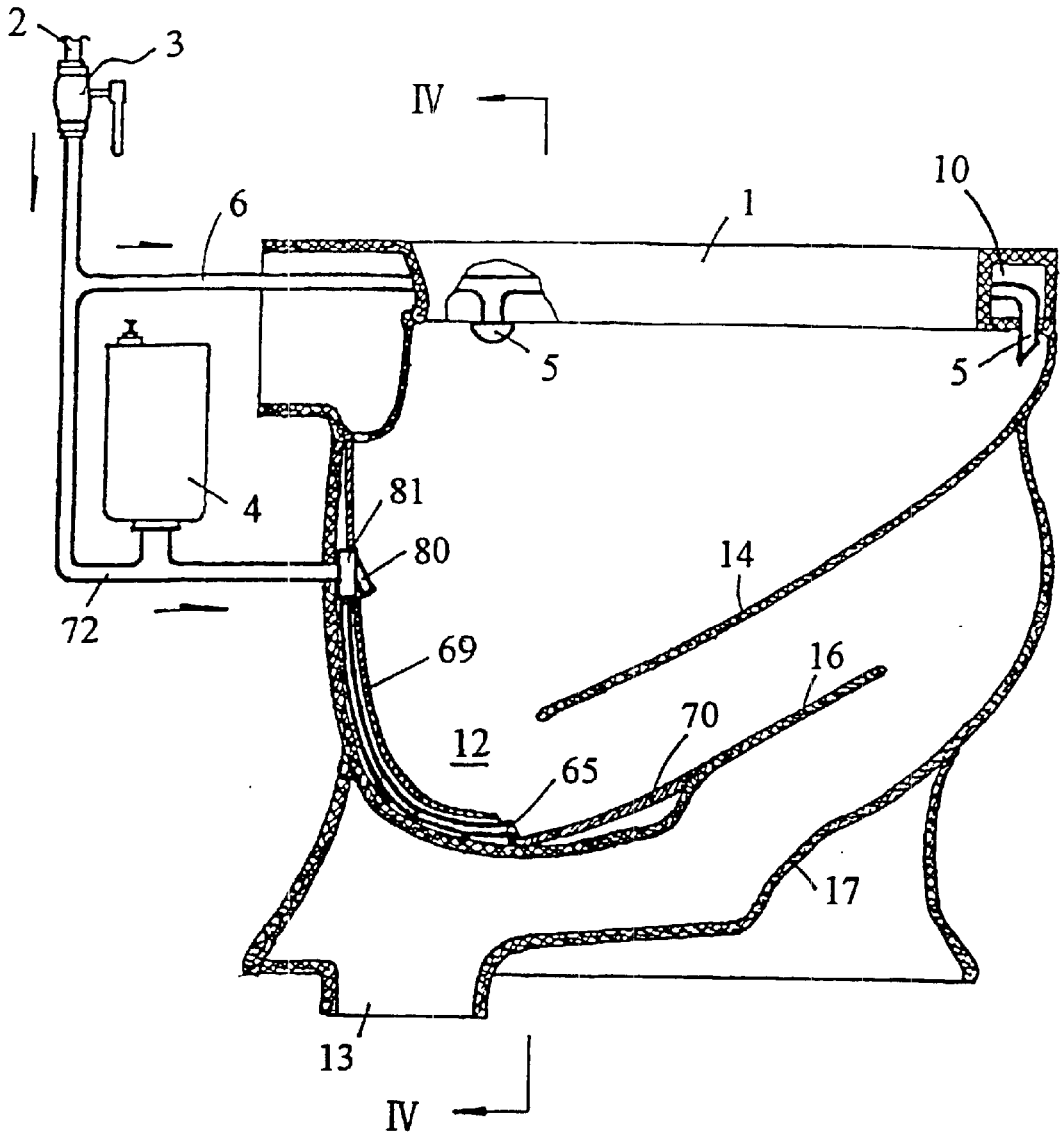
FIG. 18 is sectional view of a toilet with another kind of toilet components of the present invention.
Figure 19:
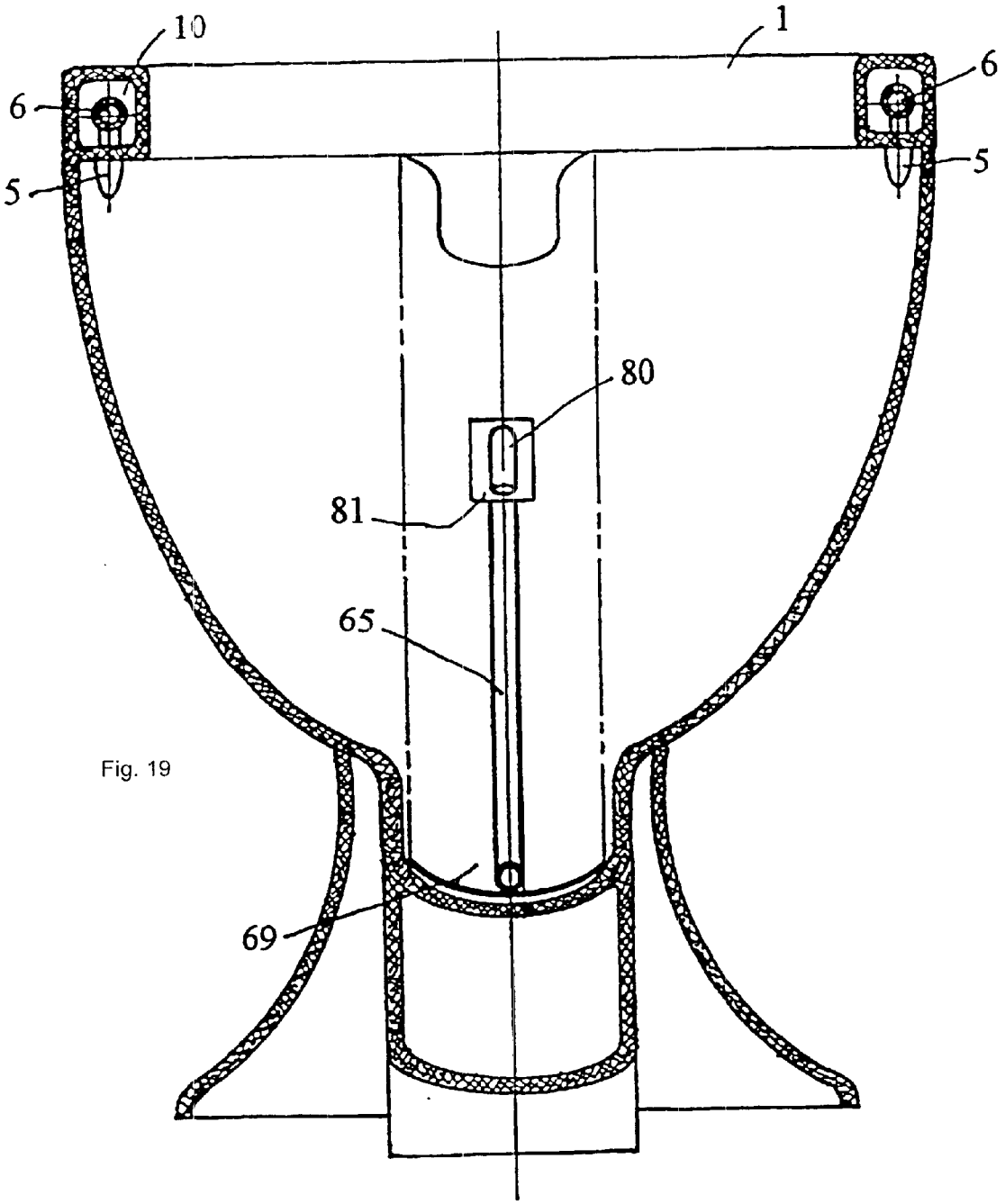
FIG. 19 is a sectional view taken along the line IV—IV in FIG. 18.

What is described in FIGS. 18 and 19 is an alternative embodiment of the components for improved toilet of the present invention, the parts identical with those of the above embodiment are indicated by the same reference numericals. The different between the present embodiment and the embodiment shown in FIGS. 13–17 is the structure and layout of the flushing nozzle. In this embodiment, the efflux communicating pipe 72 is inserted in the refitted hole opened on bowl 1. A communicating base 81 is mounted on the end portion of the efflux communicating pipe 72. On the communicating base 81 is fitted a nozzle 80 for flushing the bottom of the bowl and the trap 12. An efflux nozzle 65 is in communication with the communicating base 81. The mounting pattern of this nozzle 65 is the same as that shown in FIGS. 13 and 14. A decorative shield 69 covers over the nozzle 65 and the communicating base 81. Obviously, the shield 69 should not hamper the orifice of the nozzle. The efflux communicating pipe 72 also communicates with water supply tank 4 and flushing communicating pipe 6. The flushing communicating pipe 6 is inserted in the circulating conduit 10 formed around the upper rim of bowl 1. Openings are provided at appropriate locations on the conduit 10 and nozzles 5 whose mounting angles are adjustable are mounted on the flushing communicating pipe 6 through the openings. The efflux communicating pipe 72 communicates with the flow pipe 2 by way of the flushing control valve 3.

The following is a description of the process of operation of the present invention.

Referring to FIGS. 1–3, when bowel movement or urination is finished, a man turns the rotating handle 9 to open the flushing control valve 3, so shat water under pressure rushes respectively into the efflux communicating pipe 8 and flushing communicating pipe 6, then from communicating pipes 6 and 8 to nozzles 5 and 7 and water supply tank 4 as well. As the pressurized water entering the water supply tank 4 meets with the least resistance, water first enters the water supply tank 4. When water rises to a certain height, it will enter the sleeve 20 through the inlet 21 and push the valve core 22 upward until it blocks the through hole 26, and at the same time, the pressurized water is sprayed out from nozzles 5 and 7. The nozzle 5 is used for flushing the interior of the bowl 1, which nozzle 7 produces the flushing water with high spraying speed.

At a static state, the water in the trap cuts the toilet off from the sewer, achieving good effect of sealing and odour cut off. When the trap is in the working state, the efflux from nozzle 7 washes the egesta in the trap to the entrance 13 of the sewer. Under the high speed spray of flushing water, the negative pressure in the trap caused by the efflux pulls the egesta along with water rapidly into the sewer. When the control valve 3 is closed, the water in the water supply tank 4 flows out from the opening 19 and enters the trap 12 to form a water seal.

When using the toilet cleaning agent charging unit 30 shown in FIGS. 6–8 and the water supply tank 4 is stored with water, the pressurized water pushes forward the piston for allowing the toilet cleaning agent in the toilet cleaning agent charging unit 30 flow into the pipe segment 34. When the control valve 3 is closed, the water in the water supply tank 4 flows out from the opening 19 and enters the trap 12 along with the toilet cleaning agent to form a water seal with toilet cleanit agent. So achieve the object of eliminating the filth and odour in the trap.

The working principle of other embodiments of the present invention is essentially the same as the above-stated principle, so it is unnecessary to go into details.

The basic principle of the present invention has been described above by way of embodiments, yet those skilled in the art will clearly understand that various modifications may be made without departing from the inventive conception of the present invention; all these modifications should be within the scope of the conception of the present invention.

What is claimed is:

1. The toilet components, comprising an efflux nozzle for producing high-pressure efflux located at the bottom of a trap near the juncture of a rear sidewall of a toilet bowl and a baffle, the orientation of said high-pressure efflux being generally parallel to the extending direction of the baffle; at least one flushing nozzle provided in the bowl for flushing the bowl; a water intake pipe passing through a mounting hole on the bowl, said water intake pipe being in communication with a flushing control valve, said efflux nozzle and the flushing nozzle, said control valve being in communication with a flow pipe; said water intake pipe being in communication with a water supply tank, the volume of said water supply tank being equal to the volume of water stored in the trap, characterized in that said efflux nozzle and flushing nozzle are both connected to a base in which an upper water supply passage and a lower water supply passage are provided, a downward facing fan-shaped slot being provided at the front end of said base perpendicular to the direction of the axis of the base, said fan-shaped slot being in communication with said upper water supply passage, and forming a fan-shaped nozzle for flushing the rear part of the bowl, an inclined jet orifice being provided behind said fan-shaped slot, said jet orifice being in communication with said lower water supply passage, and forming a dashing nozzle for dashing away the egesta, said flushing nozzles being symmetrically disposed on the base, said flushing nozzles being in communication with said upper water supply passage, and forming nozzles used for flushing the two lateral sides and the front part of the bowl.

2. The toilet components according to claim 1, further including a water volume adjusting device is provided in the upper water supply passage.

3. The toilet components according to claim 1, further including a decorative shield for the purpose of covering.

4. The toilet components according to claim 2, further including a decorative shield for the purpose of covering.

* * * * *